US009751652B2

(12) United States Patent
Wolff

(10) Patent No.: US 9,751,652 B2
(45) Date of Patent: Sep. 5, 2017

(54) LABELLING MACHINE WITH WINDING DEVICE FOR A CARRIER FILM

(71) Applicant: ESPERA-WERKE GMBH, Duisburg (DE)

(72) Inventor: Peter Wolff, Swisttal-Heimerzheim (DE)

(73) Assignee: Espera-Werke GmbH, Duisburg (DE)

( * ) Notice: Subject to any disclaimer, the term of this patent is extended or adjusted under 35 U.S.C. 154(b) by 290 days.

(21) Appl. No.: 14/423,621

(22) PCT Filed: Jul. 3, 2013

(86) PCT No.: PCT/EP2013/064038
§ 371 (c)(1),
(2) Date: Feb. 24, 2015

(87) PCT Pub. No.: WO2014/060124
PCT Pub. Date: Apr. 24, 2014

(65) Prior Publication Data

US 2015/0298846 A1 Oct. 22, 2015

(30) Foreign Application Priority Data

Oct. 18, 2012 (DE) ..... 10 2012 020 419

(51) Int. Cl.
*B65C 9/18* (2006.01)
*B65C 9/40* (2006.01)
*B65C 9/00* (2006.01)

(52) U.S. Cl.
CPC ..... *B65C 9/18* (2013.01); *B65C 9/0006* (2013.01); *B65C 9/1865* (2013.01); *B65C 9/40* (2013.01);
(Continued)

(58) Field of Classification Search
CPC ..... B65C 9/0006; B65C 9/18; B65C 9/1865; B65C 9/40; B65C 2009/0009;
(Continued)

(56) References Cited

U.S. PATENT DOCUMENTS 3,783,750 A 1/1974 Heimeijer
3,881,665 A 5/1975 Leloux
(Continued)

FOREIGN PATENT DOCUMENTS

DE 2548054 C2 5/1976
DE 4220348 A1 12/1993
(Continued)

*Primary Examiner* — George Koch
(74) *Attorney, Agent, or Firm* — Rankin, Hill & Clark LLP

(57) ABSTRACT

A labelling machine with a labelling device, which has a feeder unit for feeding a backing strip, which is provided with detachable labels, and a transfer unit for transferring the labels from the backing strip onto an object that is to be labelled. The labelling machine further has a winding device for winding a section of the backing strip from which labels have been detached, containing at least one guidance unit with a guidance element, along which the backing strip section can be guided in a direction of transport, and a winding unit, which is mounted downstream of the at least one guidance element, and includes fixing means, on which a free end section of the backing strip section can be fixed, whereby the fixing means are arranged on a winding core that can rotate about an axis of rotation, and follow a rotational movement of the winding core.

18 Claims, 7 Drawing Sheets

Figure 1:
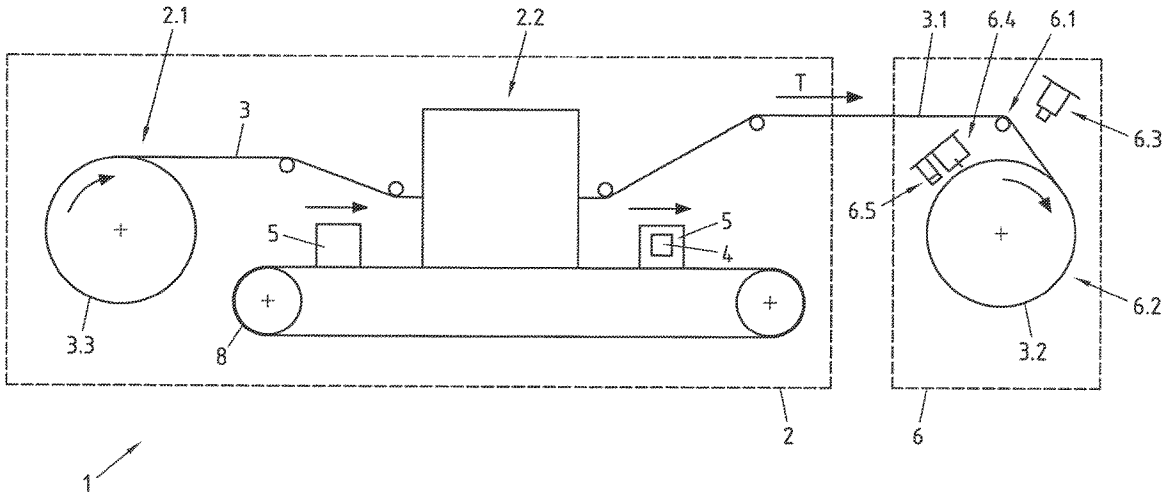

(52) U.S. Cl.
CPC ..... *B65C 2009/0009* (2013.01); *B65C 2009/0087* (2013.01); *B65C 2009/0096* (2013.01)

(58) Field of Classification Search
CPC .... B65C 2009/0087; B65C 2009/0096; B65H 18/08; B65H 18/085
USPC ..... 156/64, 540; 242/578, 578.2
See application file for complete search history.

(56) References Cited

U.S. PATENT DOCUMENTS

| | | | |
|---|---|---|---|
| 4,050,642 | A | 9/1977 | Katsumata et al. |
| 4,417,940 | A | 11/1983 | Koster |
| 4,667,890 | A | 5/1987 | Gietman, Jr. |
| 5,465,919 | A | 11/1995 | Kikuchi |

FOREIGN PATENT DOCUMENTS

| | | | |
|---|---|---|---|
| DE | 102007034698 | A1 | 1/2009 |
| EP | 0995708 | A2 | 4/2000 |
| FR | 2770502 | A1 | 5/1999 |
| GB | 2012717 | A | 8/1979 |
| JP | 05170238 | A | 7/1993 |
| JP | 08085528 | A | 4/1996 |
| JP | 2001302085 | A | 10/2001 |
| JP | 2008201527 | A | 9/2008 |
| JP | 2010023964 | A | 2/2010 |
| WO | 2010/018368 | A2 | 2/2010 |
| WO | 2012/097906 | A1 | 7/2012 |

LABELLING MACHINE WITH WINDING DEVICE FOR A CARRIER FILM

This application is 371 of PCT/EP2013/064038, filed on Jul. 3, 2013.

The present invention relates to a labelling machine with a labelling device, which has a feeder unit for purposes of feeding a backing strip, which is provided with detachable labels, and a transfer unit for purposes of transferring the labels from the backing strip onto an object that is to be labelled. The invention furthermore relates to a method for the labelling of objects such as goods or packagings, in which at least one object that is to be labelled is provided, a backing strip, which is provided with detachable labels, is fed in a direction of transport to a transfer unit, and in the transfer unit labels detached from the backing strip are transferred onto the at least one object that is to be labelled, as a result of which a backing strip section is obtained from which labels have been (completely or partially) detached.

Such a labelling machine and a corresponding method of the type cited in the introduction is of known art from DE 10 2007 034 698 A1. Such a device has one or a plurality of conveyor sections for the transport of the objects that are to be labelled, for example an item of goods or packaging. Furthermore a transfer unit is provided in which individual labels are adhered onto the object that is to be labelled. Here in accordance with one configuration of the device the labels can be fed on a backing strip, also called backing paper, from which they are detached in the transfer unit. In accordance with one alternative as described, labels that do not have any backing paper can also be applied with the cited device.

What is problematic in the case of a labelling machine of the first type cited, in which the labels are fed via a backing strip, is the collection of the backing strip section from which the labels have been detached, that is to say of the part of the backing strip which after the labelling operation is transported out of the transfer unit, and the removal of the collected material. This backing strip section must be collected in containers, whereby the containers must be regularly emptied, or replaced, when they are full.

It is therefore the object of the present invention to develop a labelling machine and a corresponding method for the labelling of objects of the type cited in the introduction to the effect that with a comparatively low level of technical effort and with the maximum possible ease of operation a removal of the backing strip section from which the labels have been detached is enabled.

In accordance with the invention this object is achieved with a labelling machine of the type cited in the introduction, in that the labelling machine furthermore has a winding device for purposes of winding on a section of the backing strip from which the labels have been detached (that is to say, completely or partially detached), containing at least one guidance unit with a guidance element, along which the backing strip section can be guided in a direction of transport, and a winding unit, which is mounted downstream of the at least one guidance element, and comprises fixing means, on which a free end section of the backing strip section can be fixed, whereby the fixing means are arranged on a winding core that can rotate about an axis of rotation, and follow a rotational movement of the winding core.

In that a winding device is provided, the said backing strip section from which the labels have been (completely or partially) detached can in the first instance be collected using simple means. This can preferably even take place in an automated manner. By means of the rotatable winding core of the winding unit the backing strip section is wound on to form a roll, in what follows called the backing strip roll, which forms a particularly space-saving option for the accommodation of backing strip material, since by virtue of the winding-on operation unused intermediate spaces between individual sections of the collected backing strip material can be avoided and accordingly a high packing density can be achieved. The accommodation of the backing strip section after the labelling operation by means of a winding unit, i.e. by means of a rotatable winding core, represents moreover a particularly simple method for collecting material in strip form and, in particular, packing it as densely as possible. Another advantage is the fact that fixing means are arranged on the rotatable winding core, for example pins, as will be described in what follows in more detail, whereby a free end section of the backing strip section from which the labels have been detached, that is to say, the front end of the backing strip or backing strip section in the direction of transport, can be fixed onto the winding core at the start of the winding operation, which in turn configures the start of the winding operation in a particularly simple manner.

What is meant by the free end section is, as stated, the part, or end, of the backing strip section, which in the direction of transport points away from the transfer unit, i.e. points towards the winding unit. The free end section is either, as determined by manufacture, the front or outer part of a backing strip fitted with labels, after the labels have been removed, or an end section that is formed by severance of, i.e. by cutting through, the backing strip section, for example, after the backing strip roll in the winding device by virtue of the winding operation has achieved a certain diameter or a certain weight, which makes necessary the removal of the roll from the winding device.

The above-cited guidance element, along which the backing strip section is guided, before it is captured by the winding unit, takes the form, for example, of a deflection element, such as a deflection roller, a deflection edge, or similar, in the simplest case just the end of a supporting surface or rail, or similar. In other words, the surface of the guidance element forms an edge, rounded as necessary, pointing away from the transfer unit, along which the backing strip section is guided, and can be deflected as necessary. Depending upon the arrangement of the winding core relative to the guidance element, however, a deflection of the backing strip section is not always necessary; in point of fact it is also conceivable that the backing strip section is guided straight onwards from the guidance element, that is to say, in what is in particular a horizontal direction, to the rotatable winding core, which in this case is located at the same height as the guidance element. For technical and/or space reasons it can, however, be desirable for the winding core, that is to say, the axis of rotation of the winding core, to lie in a horizontal plane vertically underneath the guidance element, whereby the guidance element then has a deflection function. The terms "vertical" and "horizontal" relate to the gravitational direction, that is to say "vertical" means in the direction of the gravitational force, while "horizontal" means transverse to the latter.

If a unit is said to be "mounted downstream" of another unit, this is always with reference to the direction of transport of the backing strip section. In other words, if it is stated that the winding unit is mounted downstream of the guidance element, this means that the backing strip section, if this is moving, as intended, in the direction of transport, arrives firstly at the guidance element and then at the winding unit.

In accordance with one configuration of the labelling machine according to the invention the winding device furthermore has a fan unit with at least one air outlet, that is to say, an opening that is suitable so as to allow air to flow out. The latter can in particular be designed as a blowing nozzle, which has the advantage that the exiting blowing jet, or airflow, is focussed, and has a correspondingly higher pressure. The air outlet is in particular aligned such that an airflow that exits from the latter deflects the backing strip section, after the latter has passed the guidance element, in the direction of the winding core. The air outlet is thus in particular aligned such that the part of the backing strip section that has already passed the guidance element can be pushed by means of the airflow in the direction of the winding core. In other words the air outlet is directed onto a spatial region that is necessarily traversed by the backing strip section as determined by gravitational force, after the latter has passed the guidance element. In particular the air outlet is aligned in the direction of an imaginary straight line that runs through the axis of rotation of the winding core and lies tangentially on the surface of the guidance element. With the said surface is meant the position on the guidance element that the backing strip section touches during the winding operation.

Such a fan unit has the advantage that the free end section of the backing strip section can be moved by means of the airflow ahead of the winding operation into the sphere of action, or region of rotation, of the fixing means, whereby it is enabled that the end section is automatically captured and clamped by the fixing means. With the cited sphere of action, or region of rotation, of the fixing means is thus meant the region, which with a rotation of the winding core is encompassed by the outer face of the fixing means.

In accordance with a further configuration of the labelling machine according to the invention the winding device furthermore has a parting unit with a parting element, in particular with one or a plurality of knives, i.e. blades, with one or a plurality of saw blades, with one or a plurality of needles (what is meant are pins provided with points), with a laser cutting head, or with one or a plurality of rotatable parting discs, whereby the parting element can be moved into a position in which a severance of the backing strip section can take place.

Such a severance operation is then necessary if the backing strip roll has reached a certain diameter or a certain weight, which makes it necessary for the roll to be removed from the winding core. A new winding operation can then begin. The parting element can therefore be brought into a position, which traverses across the backing strip section either in the form of the outer layer of the backing strip roll, or in the form of a sub-section not yet wound onto the backing strip roll. The parting element therefore severs the backing strip section, as a result of which the backing strip roll is separated from the remaining backing strip section and can be removed from the winding core.

In principle there are various options for designing the parting unit and the parting element. As stated the parting element can take the form of a single parting element (e.g. a single knife, saw blade, a single needle, etc.) or of a two-part parting element (e.g. in the form of a plurality of knives, saw blades, needles, etc.) In particular in the case in which the parting element is meant to sever the outer layer of the backing strip roll, the parting element, for example a saw blade, can be mounted in a sprung manner. This has the advantage that during the severance operation a certain force applied by the parting element onto the surface to be severed is not exceeded; this ensures that only the upper layer of the backing strip roll is severed and layers lying underneath, at least as far as possible, remain undamaged. In this manner the backing strip roll can simply be removed after the severance operation as a coherent entity. However, severance need not necessarily take place on the surface of the roll, but rather can also take place in the region between the roll and the labelling device, and in particular in the region between the roll and the guidance unit, preferably between the roll and the guidance element. In this region the backing strip section to be severed is under tension as a result of the tensile force that the driven winding core generates; this makes a severance operation particularly simple; in particular the backing strip section need only be partially cut into, or torn into, by the parting element, in order to then tear through independently. Also a perforation by the described needle or the described plurality of needles as a parting element is sufficient to effect a tearing of the backing strip section in the desired region. As stated a laser cutting head can also be provided, that is to say a component generating a laser beam, whereby the laser beam then effects the cut or the partial cut by heating of the backing strip section.

The travel executed by the parting element between the position in which the parting element touches the surface to be severed, and the standby position spaced apart from the former, is preferably a maximum of a few millimeters. In particular the travel lies in a range of less than 5 mm, preferably less than 3 mm, and particularly preferably in a range from 0.1 to 2 mm.

In order to enable a severance operation the parting element executes a movement that has a component parallel to the surface to be severed. This transverse movement can be effected by various types of drives, for example by an electrical, mechanical, hydraulic or pneumatic drive, preferably by an electromagnetic drive, in particular with an electrical coil and a therein guided magnet, which is mechanically connected with the parting element. Such a drive is distinguished by particularly low friction. The magnet and/or the parting element are in addition also connected with a spring, which aids the oscillating movement. The single- or multi-part parting element can moreover be eccentrically mounted, and in particular can be embodied as an eccentric knife. Additionally or alternatively the parting element can, as stated, also be of a multi-part design, for example it can have two mutually opposed saw blades or knives, whereby in this case the backing strip section must be guided between the two knives or saw blades for purposes of severing the backing strip section. In the severance operation one blade cuts on the underside, the other on the upper side; this operation preferably takes place in a section in which the backing strip section is not yet wound onto the backing strip roll. Such a so-called parallel knife, or such a so-called parallel saw, in particular if eccentrically mounted, has the advantage that no part of the parting element blocks the transport path. Thus during the severance of the backing strip section it can happen that the new free end of the backing strip section then formed retracts, and could entangle with parts (cutting sections) projecting into the transport path of the parting element. A parting element in the form of a parallel knife (or a parallel saw), which is embodied as an eccentric knife (or an eccentric saw) can, however, be arranged such that both cutting surfaces retract relative to the transport path, so that the free end, or the free end section can pass through the gap between the two parts of the parting element unhindered.

In the case in which a two-part parting element is used, for example, a parallel knife, where it is therefore necessary to guide the backing strip section between the two parts of the parting element, it is preferable if the slot width, i.e. opening, of the parting unit, through which the backing strip section must be guided, is only a few millimeters in size. In this manner a person can be prevented from inadvertently poking his/her fingers into the parting unit and into the active region of the parting element. In particular the slot width lies in a range of 1 to 8 mm, preferably in a range from 3 to 8 mm, and particularly preferably in a range from 3 to 5 mm. Finally, a build of the housing, in particular of the lower part of the housing, of the parting unit that is as flat as possible is advantageous. The flatter the latter is, the shorter is the free end that is to be guided through the air.

In accordance with another configuration of the labelling machine according to the invention the winding device furthermore has a sensor unit with at least one sensor for purposes of determining the position of the outer layer, and/or the diameter, or the radius, of the backing strip roll. Such a sensor can be embodied as a capacitive switch, an ultrasound sensor, a laser, or a mechanical limit switch. In principle, however, the sensor can also be designed for purposes of determining the weight of the backing strip roll, that is to say for example in the form of a load cell; the latter could then be arranged in the rotation shaft or the winding core. The sensor can then generate an appropriate signal and transmit it to a control unit, which signal can trigger the subsequent actions that are thereupon appropriate (in particular the severance and/or removal of the backing strip section from which the labels have been detached), as are described in more detail in what follows. A sensor unit is, however, not essential. Thus it is also conceivable that the control unit is configured such that from the known backing strip thickness (this can be programmed or automatically measured) it can calculate the point in time or the window in time (time period) at which the cited subsequent actions are to be triggered.

Firstly, however, the winding unit must once again be described in more detail. In accordance with one configuration of the labelling machine this has as fixing means at least two, preferably at least three, particularly preferably at least four, pins extending parallel to the axis of rotation of the winding core and parallel to one another, and spaced apart from one another in the radial direction. Here "radial" is viewed with reference to the axis of rotation of the winding core. At the same time all fixing means are also preferably spaced apart from this axis of rotation.

One or a plurality of the fixing means, or pins, preferably all fixing means, or pins, can be moved between an extended position and a retracted position. With the "extended position" is meant a position in which the respective fixing means in question projects sufficiently far above the surface of the winding core that the backing strip section, that is to say the free end section, can be fixed onto the winding core. In the extended position the fixing means in question preferably protrudes at least as far as the backing strip section is wide. In other words in the extended position the length of the fixing means in question corresponds to at least the width of the backing strip section. With the "retracted position" is meant a position in which the respective fixing means protrudes less than in the extended position, or in fact does not protrude at all.

Various configurations and scenarios are conceivable as to how the fixing means, or pins, can be moved between the extended and retracted positions.

In accordance with one advantageous configuration four fixing means are provided, all of which can be lowered, that is to say, can be moved between an extended and a retracted position. The end faces of the fixing means, or pins, preferably project out of the winding core and extend parallel to the axis of rotation of the winding core. The fixing means, or pins, all have the same distance from one another and also have the same distance from the axis of rotation of the winding core. The pins can be lowered, that is to say, can be brought into the retracted position, either individually, or in pairs, or all together. The same is true also for the movement into the extended position.

The above cited fixing means, or pins, can also be of different lengths, or can protrude to a different extent in the extended position, whereby in particular a pair of opposing (with reference to the axis of rotation of the winding core) fixing means, or pins, has the same length.

At the start of the winding operation, in order to fix the free end section of the backing strip section onto the winding core automatically, it is conceivable that of the four fixing means, or pins, in the first instance two are lowered, that is to say, are located in the retracted position, and the other two are in the extended position. In the case in which the pins in the extended position project to different extents from the winding core, in the first instance the later less far protruding pins remain lowered, and the pins protruding further out of the winding core are extended. The lowered pins are thereby located opposingly with reference to the axis of rotation of the winding core, that is to say, the axis of rotation is located between the two lowered fixing means, or pins. The same applies accordingly also for the extended fixing means, or pins. In this state it is possible for the air outlet to direct an airflow onto the backing strip section, and to deflect the latter onto the extended fixing means, or pins.

Here the position of the winding core, for the exemplary application in which the winding core at this instant should not rotate, can be selected such that the extended fixing means, or pins, are arranged on an imaginary straight line, which runs parallel to, or at an acute angle of preferably less than 30°, particularly preferably less than 15°, to a straight line that runs through the axis of rotation of the winding core and which lies tangentially on the surface of the guidance element. If the position of the winding core at this point in time does not correspond to these conditions, the winding core is preferably rotated into a position that corresponds to the conditions, or the extended fixing means, or pins, are lowered, and the lowered fixing means, or pins, are extended. As soon as a suitable position of the winding core and the fixing means has been set, the air outlet can direct an airflow onto the backing strip section, and can deflect the latter onto the two extended fixing means, or pins, as a result of which the backing strip section runs through the active region, i.e. the region of rotation, of the fixing means.

In that the two previously lowered fixing means, or pins, are extended, it is achieved that the free end section of the backing strip section runs between at least two fixing means, i.e. at least one fixing means is extended on each side of the backing strip section. By the rotation of the winding core the backing strip section clamps itself at the latest after half a rotation of the winding core such that a fixing of the free end section is achieved. In principle it would also be possible, instead of four fixing means, to use only three, or even two fixing means, as a result of which a comparable clamping effect would be achieved. In principle it would also be conceivable to use just a single fixing means, but one that for this purpose is slotted, whereby in this case, however, the free end of the backing strip section would have to be introduced by hand into the fixing means slot.

Alternatively it is also conceivable that at the start of the winding operation, in order to fix the free end section onto the winding core, in the first instance all fixing means, or pins (with the use of four fixing means, therefore, all four fixing means) are in the first instance lowered and with the aid of an airflow from an air outlet the backing strip section is brought into the active region, i.e. the region of rotation, of the fixing means. In order to simplify the positioning of the backing strip section, a bearing element can be provided on the opposite side of the guidance element with respect to the winding core, the surface of which bearing element preferably lies on an imaginary straight line that runs through the active region (region of rotation) of the fixing means, and in particular through the axis of rotation of the winding core, and which lies tangentially on the surface of the guidance element. Here the distance between guidance element and winding core is less than the distance between guidance element and bearing element. In other words the axis of rotation of the winding core, or the winding core, lies between guidance element and bearing element. The airflow from the air outlet thereby deflects the backing strip section against the bearing element, so that the backing strip section lies on both the bearing element and also on the guidance element, and accordingly runs through the active region (region of rotation) of the fixing means arranged between the bearing element and the guidance element. If the fixing means, or pins, are then moved into the extended position, the backing strip section always extends between at least two of the fixing means. As a result of the rotation of the winding core the backing strip section is automatically clamped appropriately in this case also.

Additionally or alternatively to the bearing element provision can also be made for the air outlet to be designed, i.e. aligned, such that the airflow exiting from the latter runs parallel to an imaginary straight line that runs through the axis of rotation of the winding core and lies tangentially on the surface of the guidance element.

Additionally or alternatively, for purposes of positioning the backing strip section within the active region (region of rotation) of the fixing means, a plurality of air outlets of the type cited can also be provided such that the backing strip section is guided between two flows of air, or blowing jets.

Likewise additionally or alternatively, for purposes of positioning the backing strip section within the active region (region of rotation) of the fixing means provision can be made for the said active region (region of rotation) to be arranged vertically underneath the outer edge (deflection edge) of the guidance element, so that deflection takes place purely as a result of the gravitational force on the backing strip section in the direction of the active region (region of rotation) of the fixing means, i.e. in the direction of the axis of rotation of the winding core. This can then be additionally aided by one or a plurality of directed airflows.

The use of a fan unit with one or a plurality of air outlets can also be used for the purpose of deflecting the free end section of the backing strip section into the slot, i.e. into the opening of the parting unit. Accordingly, in accordance with one configuration of the labelling machine according to the invention the winding device has a fan unit with at least one air outlet, which is aligned such that an airflow exiting from the latter deflects the backing strip section, in particular the free end section of the latter, into an inlet—by which is meant the said slot, i.e. said opening—of the parting unit. For this purpose at least two air outlets of the type cited are preferably provided, which are aligned at an angle to one another and which guide the backing strip section along between two airflows.

Finally, in accordance with another configuration of the labelling machine according to the invention a control unit is provided, as already stated. In particular the winding device has a control unit which is configured such that:

- dependent on a signal generated by the sensor, or dependent on a programmed, or automatically measured, value for the backing strip thickness
  - it can slow down or stop a rotation of the winding core (in particular it can match it to the necessary speed of transport), and/or
  - it can actuate the parting unit, and/or
  - it can move the fixing means from the extended position into the retracted position, and/or
  - it can switch on the fan unit and/or

- that dependent on the throughput performance of the labelling machine:
  - it can move the fixing means from the retracted position into the extended position, and/or
  - it can initiate or accelerate the rotation of the winding core, and/or
  - it can switch off the fan unit.

In other words, in the case in which it is established by the sensor or by the calculation on the basis of the known backing strip thickness that the backing strip roll must be replaced at a particular point in time or in a particular time window, the control unit is suitable, at this point in time, or in this time window, for the purpose of slowing down or stopping the rotation of the winding core, for the purpose of effecting a parting of the backing strip section, for the purpose of lowering the fixing means, or pins, as a result of which the roll is released from the winding core, and/or for the purpose of switching on the fan unit, in order thereby to position the backing strip section before a new winding operation can begin.

It should be noted that it is not essential for the rotation of the winding core to be stopped in order to enable the roll to be released from the winding core, or to enable a severance of the backing strip section. Rather it is possible for the winding core to continue to rotate with the same or a reduced speed. In this case accordingly no restart of the rotation of the winding core is necessary in order to initiate the new winding operation. The control unit can in particular be configured such that it matches the rotational speed of the winding core to the necessary speed of transport of the backing strip section and/or to the outer diameter of the backing strip roll that is being wound, thus in the course of the winding operation the outer diameter and consequently the periphery of the backing strip roll that is being wound increases, as a result of which it is advantageous if the rotational speed of the winding core is reduced (in particular such that it is consistent with the increasing outer diameter). Accordingly, the outer diameter and consequently the periphery of the roll at the start of a new winding operation is a minimum, so that the rotational speed is then advantageously increased.

Before the start of the winding operation the control unit can also move the fixing means from the retracted position into the extended position, and thereby effect a fixing of the backing strip section at the start of the winding operation; it can initiate the winding operation by initiating or accelerating the rotation of the winding core, and it can switch off once again the fan unit, which was switched on for purposes of positioning the backing strip section within the active region (region of rotation) of the fixing means.

It is also conceivable that the control unit is configured such that it effects the severance of the backing strip section and/or the release of the backing strip roll up to a point in time at which more backing strips are introduced into the labelling device. In this case the control unit must therefore also check the extent to which backing paper is still present in the device, and then initiate the operation of severance and/or release accordingly.

The above-indicated task is also solved by means of a method for purposes of the labelling objects such as goods or packagings, in particular with the use of the above-described labelling machine, with which the following steps are executed:

- provision of at least one object that is to be labelled,
- feeding of a backing strip (for example as roll products or Liporello), which is provided with detachable labels, in a direction of transport to a transfer unit,
- transfer of labels detached from the backing strip in the transfer unit onto the at least one object that is to be labelled, as a result of which a backing strip section from which the labels have been detached (completely or partially) is obtained,
- feeding of a free end section of the backing strip section from which the labels have been detached to a winding unit of a winding device, which is mounted downstream of the transfer unit,
- winding of the backing strip section from which the labels have been detached in the winding device, as a result of which a backing strip roll is obtained,
- severance of the backing strip section from which the labels have been detached, as a result of which the backing strip roll is separated from the remaining backing strip section, and
- release of the separated backing strip roll from the winding unit.

Also by means of the method according to the invention it is achieved that with comparatively low technical effort and a high level of ease of operation the removal of the backing strip, i.e. the backing paper, is enabled and in fact also under very economical conditions, by virtue of the high (packing) density of the wound backing strip roll that is achieved.

In accordance with one configuration of the method according to the invention the free end section of the backing strip section from which labels have been completely or partially detached is automatically fixed, in particular is clamped, in the winding device. This takes place in particular in the above-described manner using the movable fixing means, or pins.

In accordance with another configuration of the method according to the invention, as has similarly been described, the position of the outer layer and/or the diameter, or the radius, or the weight of the backing strip roll is determined during the winding operation and with the achievement of a prescribed reference value or range of reference values a signal is generated by a sensor, whereupon, preferably automatically, the severance of the backing strip section is executed. As stated, the optimal point in time or the optimal time window for the severance operation can, however, also be calculated by the control unit based on a programmed, or automatically measured, value for the backing strip thickness. As explained, it is not necessary for the rotation of the backing strip roll, i.e. of the winding core, to be stopped for the severance operation. The reference value, or range of reference values, is in particular selected such that a maximum number of windings (layers) of the backing strip roll can be achieved, without the outer layer of the latter bumping against a part of the labelling machine, and in particular on a part of the winding device. The range of reference values for the radius can, for example, lie between 60 and 200 mm, preferably between 90 and 180 mm, and particularly preferably between 150 and 160 mm. If the sensor determines such a radius a signal can be generated which either displays to an operator that the backing strip roll has achieved its desired size, or automatically terminates the winding operation, for example by the severance of the backing strip section.

In accordance with a further configuration of the method according to the invention provision can also be made that in the step of releasing (discarding) the separated backing strip roll the latter is automatically released from the winding unit, and in particular a subsequent winding operation is automatically initiated, as has already been explained. In principle, however, it is also conceivable that an operator removes the backing strip roll manually. The same is true also for the severance of the backing strip section, which preferably takes place automatically, but in principle can also be executed manually.

Finally, in accordance with another configuration of the method according to the invention, provision is made that:

- dependent on a signal generated by the sensor, or dependent on a programmed, or automatically measured, value for the backing strip thickness
  - a rotation of the winding core is slowed (in particular is matched to the necessary speed of transport), or stopped, and/or
  - the backing strip section is severed, and/or
  - the backing strip section is released from the winding unit, and/or
  - a fan unit blowing air onto the free end section of the backing strip section is switched on and/or

- that dependent on the throughput performance of the labelling machine at the start of the winding operation:
  - the free end section of the backing strip section is fixed, and/or
  - the rotation of the winding core, which carries the later backing strip roll, is initiated or accelerated, and/or
  - a fan unit blowing air onto the free end section of the backing strip section is switched off.

Also at this point it should once again be noted that the rotation of the backing strip roll does not necessarily have to be stopped, and accordingly, after the removal of the backing strip roll, the rotation of the winding core does not necessarily have to be initiated, since the removal, or discard, of the backing strip roll and also the severance of the backing strip section can take place while the winding core is rotating.

Figure 2A:
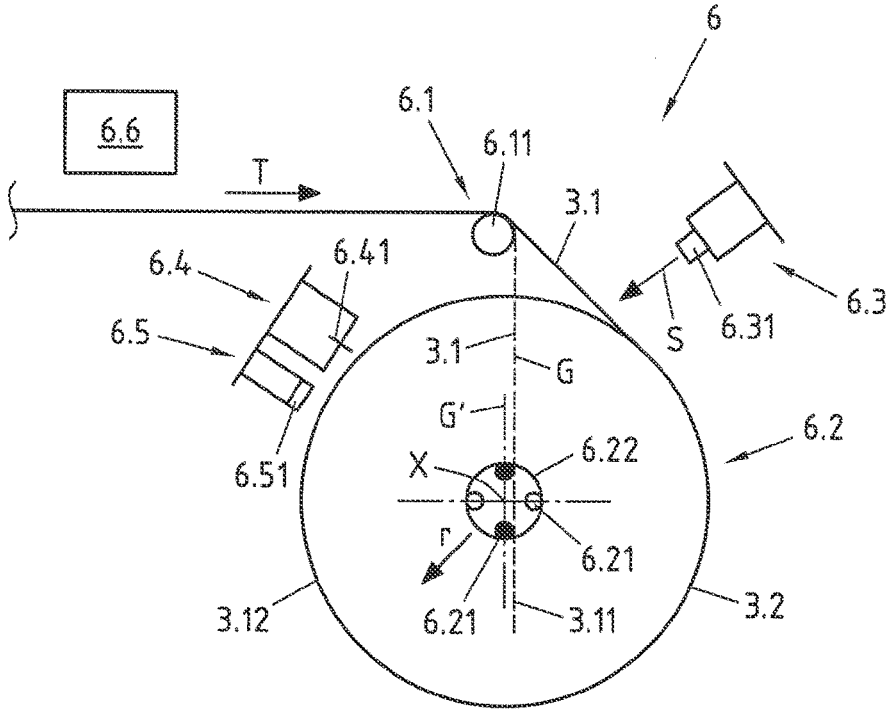
Figure 2B:
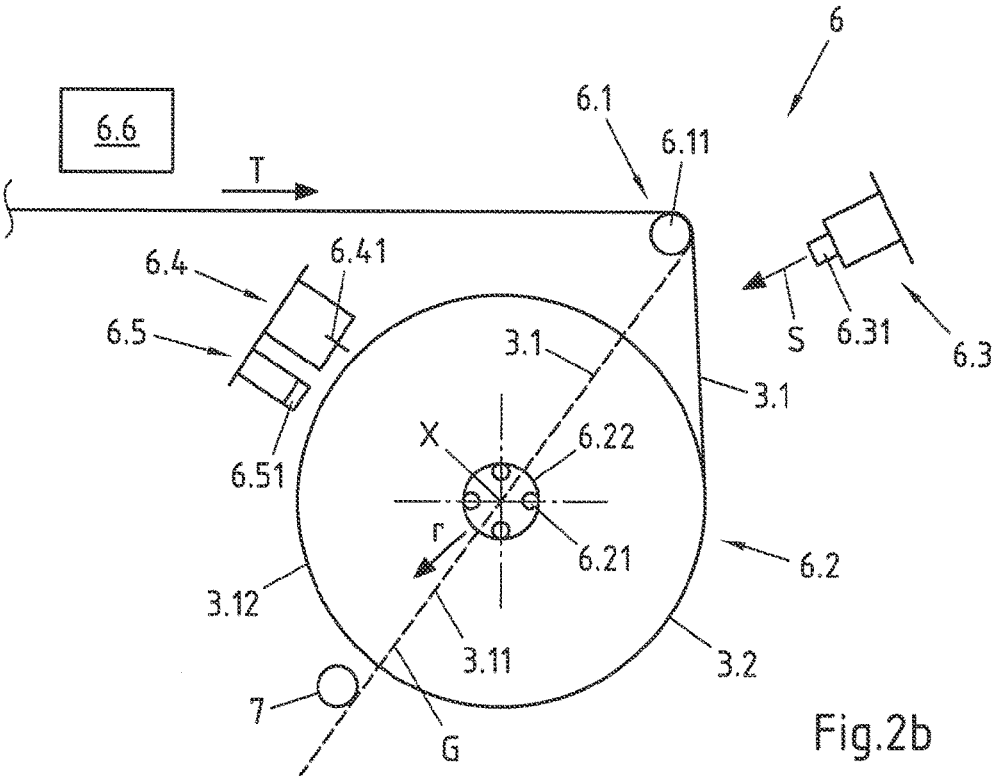
Figure 2C:
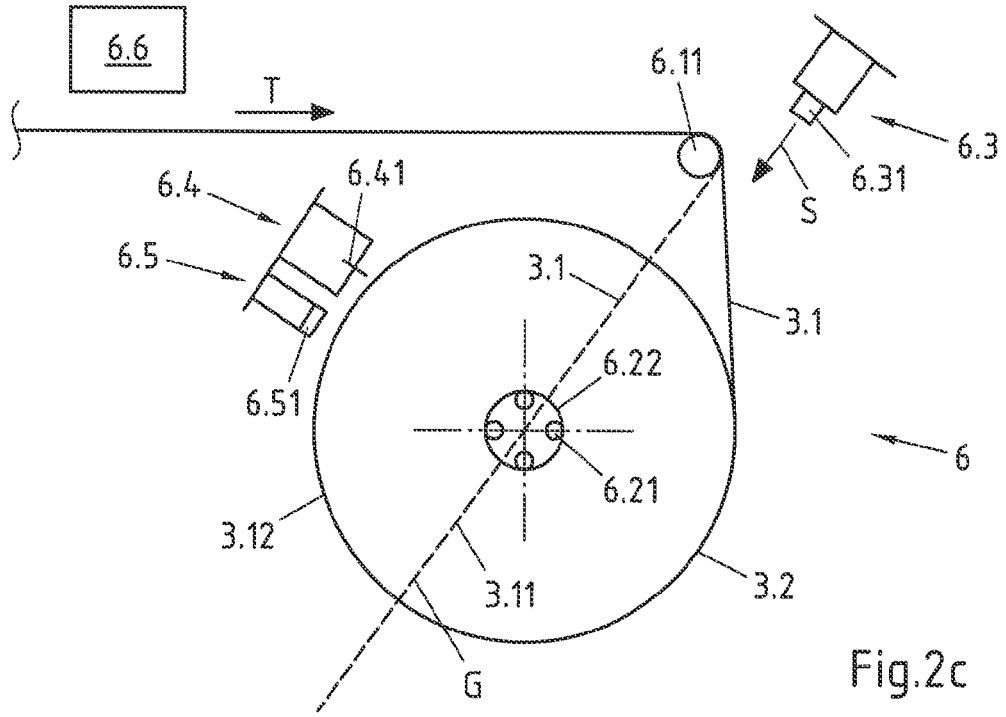
Figure 2D:
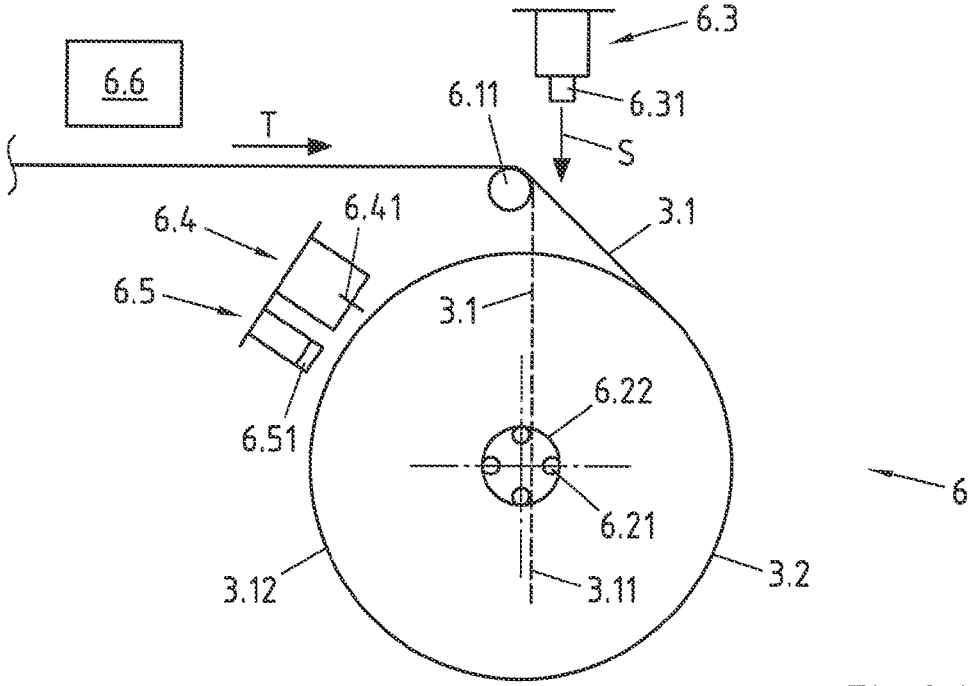
Figure 2E:
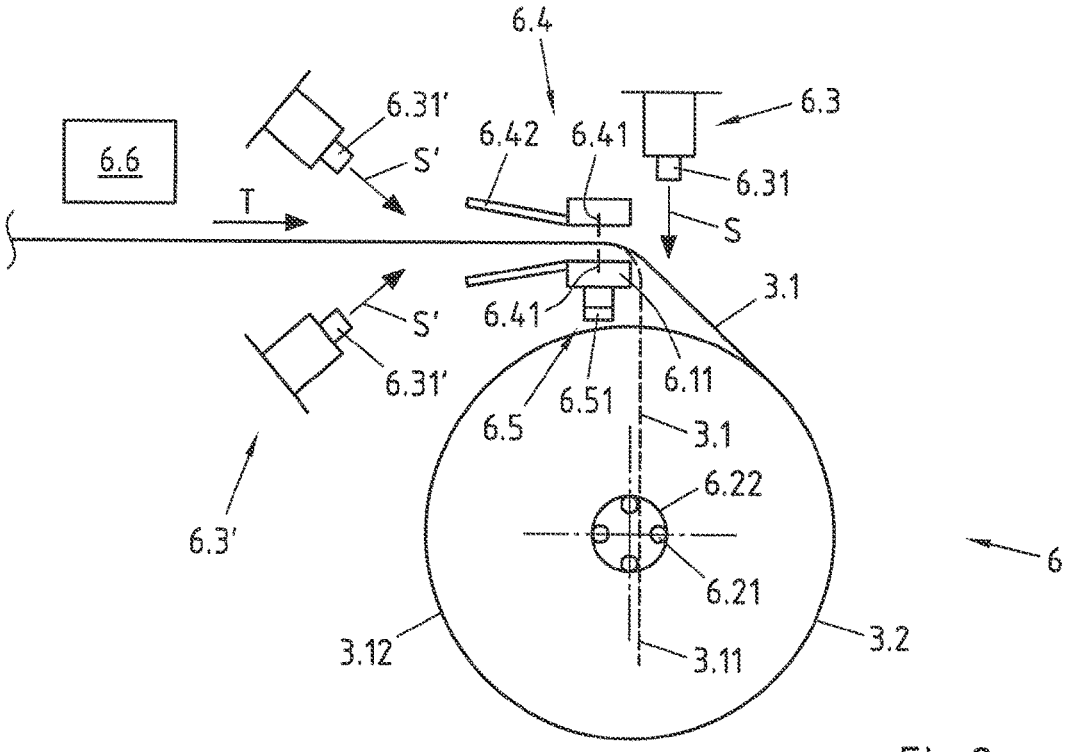
Figure 2F:
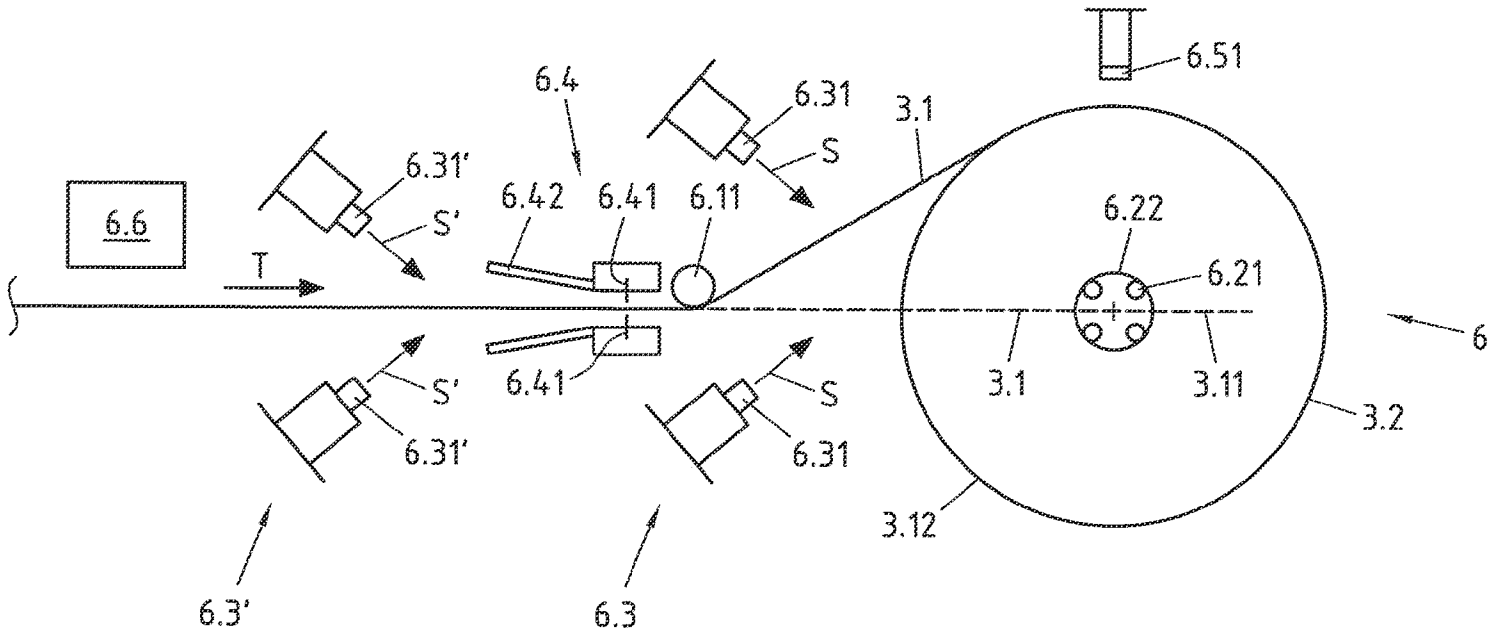
Figure 3A:
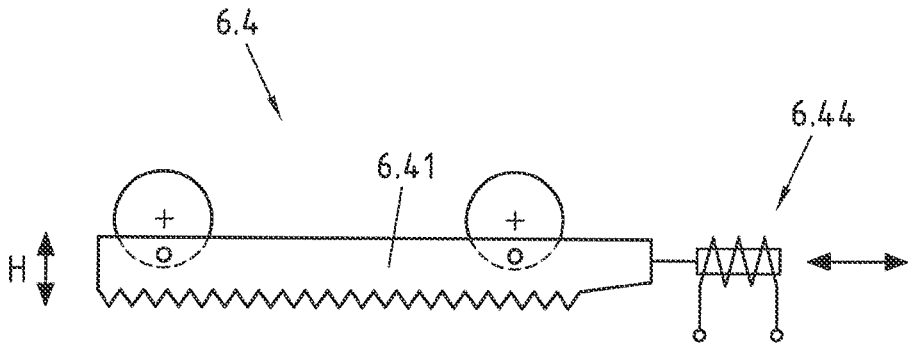
Figure 3B:
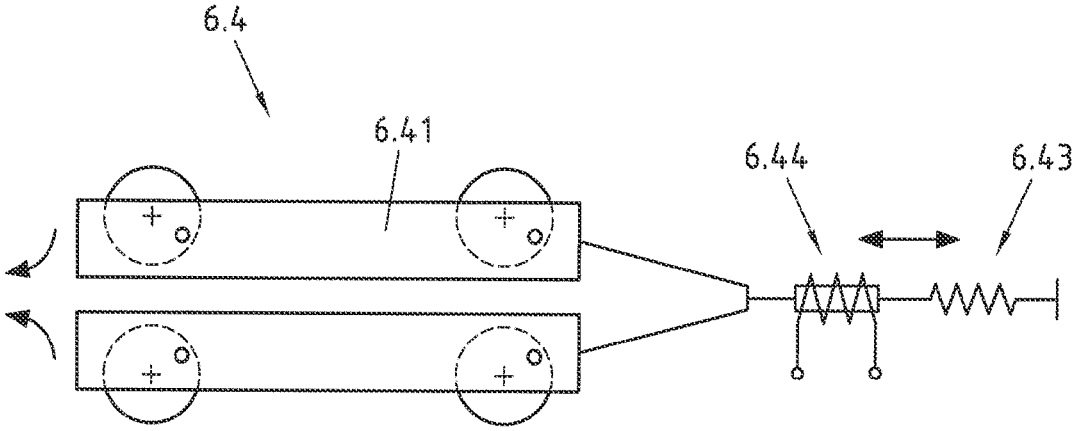
Figure 3C:
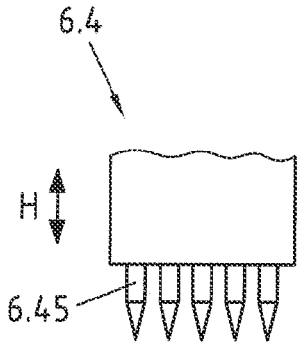
Figure 4A:
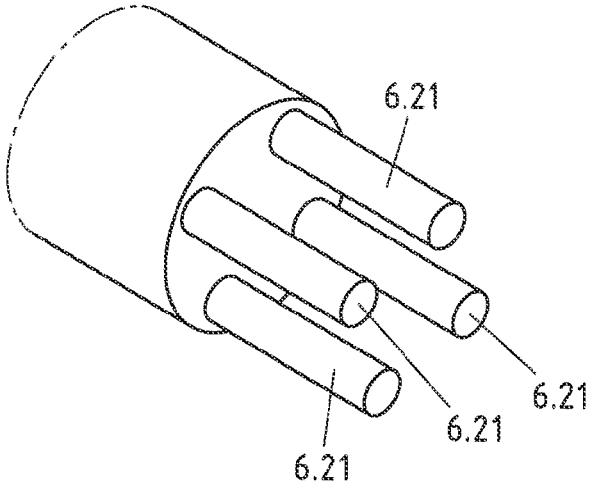
Figure 4B:
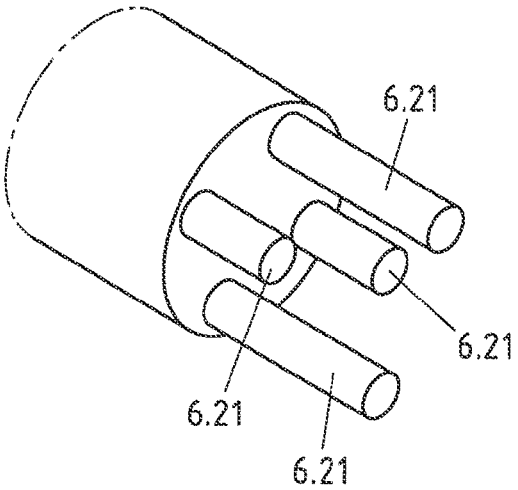

There are now a multiplicity of options for configuring and developing further the labelling machine according to the invention and the method according to the invention. In this regard reference is made on the one hand to the claims following claim 1, and on the other hand to the description of examples of embodiment in conjunction with the drawing. In the drawing:

FIG. 1 shows a schematic representation of a labelling machine in accordance with the present invention, FIG. 2*a*) shows a schematic representation of a first example of embodiment of a winding device of a labelling machine according to the invention, FIG. 2*b*) shows a schematic representation of a second example of embodiment of a winding device of a labelling machine according to the invention, FIG. 2*c*) shows a schematic representation of a third example of embodiment of a winding device of a labelling machine according to the invention, FIG. 2*d*) shows a schematic representation of a fourth example of embodiment of a winding device of a labelling machine according to the invention, FIG. 2*e*) shows a schematic representation of a fifth example of embodiment of a winding device of a labelling machine according to the invention, FIG. 2*f*) shows a schematic representation of a sixth example of embodiment of a winding device of a labelling machine according to the invention, FIG. 3*a*) shows a schematic representation of a first example of embodiment of a parting unit for a winding device in accordance with FIGS. 2*a*) to *f*), FIG. 3*b*) shows a schematic representation of a second example of embodiment of a parting unit for a winding device in accordance with FIGS. 2*a*) to *f*), FIG. 3*c*) shows a schematic representation of a third example of embodiment of a parting unit for a winding device in accordance with FIGS. 2*a*) to *f*), FIG. 4*a*) shows a schematic representation of a first example of embodiment of a winding core for a winding device in accordance with FIGS. 2*a*) to *f*), FIG. 4*b*) shows a schematic representation of a second example of embodiment of a winding core for a winding device in accordance with FIGS. 2*a*) to *f*), FIG. 1 shows in a schematic representation the principles of a labelling machine 1 in accordance with the present invention, which has a labelling device 2 and a winding device 6. The labelling device 2 has a feeder unit 2.1 for purposes of feeding a backing strip 3, which is provided with detachable labels 4, and a transfer unit 2.2 for purposes of transferring the labels 4 from the backing strip 3 onto an object 5 that is to be labelled. The object 5 that is to be labelled is thereby, as is represented with arrows, transported on a transport belt 8 or similar through the transfer unit 2.2, whereby, as is represented in FIG. 1, before entry into the transfer unit the object 5 (the left-hand object in FIG. 1) does not yet bear any designated label 4, whereas after passing through the transfer unit 2.2 a label 4 has been adhesively attached onto the object 5 (the right-hand object in FIG. 1).

As stated, the labels 4 are detachably fitted to a backing strip 3, which here is provided as a continuous roll 3.3. The backing strip 3 is unrolled from the said continuous roll 3.3, guided through the transfer unit 2.2 and then, after some or all of the labels 4 have been detached from the backing strip 3, is fed to a winding device 6.

FIGS. 2*a*) to *f*) show examples of embodiment of a winding device 6.

In principle the section 3.1 of the backing strip 3 from which labels 4 have been removed is wound on in the winding device 6, as a result of which a backing strip roll 3.2 is formed. In order to be able to fix a free end section 3.11 of the backing strip section 3.1 automatically in a winding unit 6.2 of the winding device 6 a fan unit 6.3 is provided as an aid, which can direct a directed airflow S onto the backing strip section 3.1 for purposes of exact positioning of the end section 3.11. A sensor unit 6.5 detects when the backing strip roll 3.2 has achieved a predetermined size, whereupon the backing strip section 3.1 can be severed by means of a parting unit 6.4. The backing strip roll 3.2 can then be released and removed from the winding device 6, whereupon a new winding operation can begin. The backing strip roll 3.2 removed from the winding device 6 can then be disposed of.

The examples of embodiment in FIGS. 2*a*) to *f*) have in common the fact that the winding device 6 has a guidance unit 6.1 with a guidance element 6.11, on which the backing strip section 3.1 can be guided along in a direction of transport T, and a winding unit 6.2, which is mounted downstream of the at least one guidance element 6.11, and the fixing means 6.21, on which a free end section 3.11 of the backing strip section 3.1 can be fixed, whereby the fixing means 6.21 are arranged on a winding core 6.22 that can rotate about an axis of rotation X, and follow a rotational movement of the winding core 6.22.

In accordance with the schematically represented examples of embodiment in FIGS. 2*a*) to *f*), the winding device 6 furthermore has a fan unit 6.3 with at least one air outlet 6.31, which is aligned such that an airflow S that exits from the latter deflects the backing strip section 3.1, after this has passed the guidance element 6.11, in the direction of the winding core 6.22.

In addition the individual examples of embodiment of the winding device 6 also have a parting unit 6.4 with a parting element 6.41, for example a knife, a saw blade, or a rotatable parting disc, whereby the parting element 6.41 can be moved into a position in which a severance of the backing strip section 3.1 can take place. In the examples of embodiment represented the parting element can also be designed as a laser cutting head, whereby the cut is then effected by heating of the backing strip section 3.1 by means of the laser beam.

Finally, in all the examples represented, the winding device 6 has a sensor unit 6.5, which is provided with at least one sensor 6.51, which is suitable for purposes of determining the position of the outer layer 3.12, and/or the diameter, or the radius, of a backing strip roll 3.2, which has been generated by means of the winding unit 6.2 from the backing strip section 3.1. It is also conceivable to provide a sensor that determines the weight of the backing strip roll 2.3, the latter could then be arranged in the rotation shaft or the winding core 6.22.

In accordance with FIG. 2*a*) four pins 6.21 are arranged as fixing means 6.21 on the winding core 6.22; these extend parallel to the axis of rotation X of the winding core 6.22 and parallel to one another, and are spaced apart from one another in the radial direction r. The pins 6.21 all have the same distance from one another, and all also have the same distance from the axis of rotation X. The pins 6.21 can all be moved between an extended position and a retracted position. Of the four pins 6.21, in order to be able to start a winding operation, in the first instance two, each opposed to one another, between which therefore the axis of rotation X runs, can be arranged in the extended position (pins in FIG. 2*a*), each symbolised by dark points), while the other two pins, which are also opposed, are in the retracted position (pins in FIG. 2*a*), each symbolised by light points).

The two extended pins 6.21 serve as a bearing for the end section 3.11 of the backing strip section 3.1 that is to be fixed on the winding core 6.22. Thus the end section 3.11, after this has passed the guidance element 6.11, is deflected by an airflow S from the air outlet 6.31 in the direction of the winding core 6.22 and the two extended pins 6.21, until the end section 3.11 bears upon the two extended pins (this starting position of the end section 3.11 before the start of the fixing and winding operations is represented by a dashed line in FIGS. 2*a*) to *f*)). In this special case the winding core 6.22, at the moment when the end section 3.11 makes contact with the pins 6.21, has a position such that the extended pins 6.21 are arranged on an imaginary straight line G, which runs parallel to a straight line G', which runs through the axis of rotation X of the winding core 6.22, and which lies tangentially on the surface of the guidance element 6.11.

The two pins that have been lowered up to this point are then also traversed into the extended position, as a result of which the end section 3.11 is clamped between the pins 6.21. The fan unit 6.3 is thereupon switched off. As soon as the sensor 6.51 determines a particular thickness of the backing strip roll 3 an appropriate signal is transmitted to a control unit 6.6. The parting unit 6.4 thereupon severs the upper layer 3.12 of the backing strip section 3.1 that has been wound on to form a roll 3.2. For the severance operation the rotation of the winding core 6.22 can be stopped or slowed down. However, the winding core 6.22 can also continue to rotate with the same speed during the severance operation.

The severance operation takes place, for example, by means of a parting unit, as is represented in FIG. 3*a*). The parting unit represented in FIG. 3*a*) has a saw blade 6.41, which is eccentrically mounted, and thereby executes a movement that has a vertical and a horizontal component. The vertical component of movement is here designated as a travel H. The travel H lies, for example, at 1 to 2 mm. In the lower travel position the saw blade 6.41 touches the surface of the backing strip section 3.1 that is to be severed. At the same time the saw blade 6.41 is mounted in a sprung manner (not represented) in the vertical direction, that is to say in the direction of the travel movement, so that a particular force applied by the saw blade 6.41 onto the surface that is to be severed is not exceeded. The horizontal component of movement is effected by a horizontally oscillating drive, in FIG. 3*a*), for example, by an electromagnetic drive 6.44 with a magnet guided in an electrical coil. The severance operation could also take place by means of a parallel knife 6.41, as is represented in FIG. 3*b*) and is further described in what follows. Alternatively a parting unit 6.4 with a plurality of needles 6.45 can also be provided (FIG. 3*c*); these serve to perforate the backing strip section 3.1, so that the latter independently tears through at this point.

In the example of embodiment in accordance with FIG. 2*a*), after the severance operation has taken place, all four pins 6.21 are lowered, as a result of which the backing strip roll 3.2 is released and can be disposed of.

The example of embodiment of a winding device 6 in FIG. 2*b*) is constructed in a similar manner. Here, however, the four pins 6.21 always move simultaneously into the retracted or the extended position. In order before the start of the winding operation to be able to fix the end section 3.11 onto the pins 6.21, in the first instance all pins 6.21 are lowered, whereupon the airflow S from the air outlet 6.31 deflects the still free end section 3.11 in the direction of a straight line G, which runs through the axis of rotation X of the winding core 6.22, and which lies tangentially on the surface of the guidance element 6.11. Here the end section 3.11 bears upon a bearing element 7, the surface of which also lies on the imaginary straight line G. In this manner it is ensured that the backing strip section 3.1 runs through the region of rotation of the pins 6.21, and is automatically clamped by the pins 6.21 in the extended state.

A further difference between FIG. 2*a*) and FIG. 2*b*) is that in FIG. 2*a*) the winding core 6.22 lies vertically underneath the outer edge of the guidance element 6.11, so that gravitational force aids the positioning of the still free end section 3.11 in the region of the winding core 6.22. In FIG. 2*b*), in contrast, the winding core 6.22 does not lie vertically underneath the outer edge of the guidance element 6.11, but instead is laterally displaced from this position towards the labelling device 2. The displacement can also be provided in the other direction, that is to say, away from the labelling device 2.

Both in the case of FIG. 2*a*), and also in the case of FIG. 2*b*), the airflow S is aligned at an angle to an imaginary straight line that runs through the axis of rotation X and lies tangentially on the guidance element 6.11. In FIG. 2*c*), on the other hand, the airflow S runs parallel to an imaginary straight line G that runs through the axis of rotation X of the winding core and lies tangentially on the surface of the guidance element 6.11. In the latter example of embodiment the parallel alignment of the airflow S ensures that the still free end section 3.11 moves into the region of rotation of the pins 6.21 without the need for a bearing element 7. The example of embodiment in accordance with FIG. 2*c*) corresponds with that shown in FIG. 2*b*), whereby in FIG. 2*c*) the said bearing element 7 has been omitted.

FIG. 2*d*) shows an example of embodiment of a winding device 6, which essentially corresponds with that in FIG. 2*a*). However, in FIG. 2*d*) a parallel incident flow onto the still free end section 3.11 is provided, whereas the incident flow in FIG. 2*a*) is selected to be at an angle.

In the example of embodiment in FIG. 2*e*) there takes place, as in the example of embodiment in FIG. 2*d*), similarly a parallel incident flow onto the free end section 3.11 by the airflow S; here, however, the parting unit 6.4 is not arranged at the side of the roll 3.2, but rather vertically above the roll in a region in which the backing strip section 3.1 is not yet wound onto the roll, and accordingly therefore has not yet passed the guidance element 6.11. Here the latter forms the exit from the parting unit 6.4, so that in this example of embodiment the guidance element 6.11 is part of the housing of the parting unit 6.4.

In FIG. 2*e*) the parting unit 6.4 has a two-part parting element 6.41 in the form of a parallel knife. This is schematically represented in FIG. 3*b*). Each of the two blades of the parallel knife 6.41 is mounted eccentrically and executes a synchronous movement relative to the other with a vertical component and a horizontal component, whereby, as in FIG. 3*a*), here too the horizontal component is effected by an electromagnetic drive 6.44 with a magnet guided in an electrical coil. The latter is in addition connected with a spring 6.43 for purposes of aiding the oscillating movement. Such a parallel knife has the advantage that the blades, which sever the backing strip section 3.1 from above and from underneath, can be pulled back out of the transport path to the extent that after the severance operation the new end section 3.11 can be guided through the gap between the cutting edges without the risk of any entanglement.

In order to aid the guidance of the end section further, an additional fan unit 6.3' is provided in the example of embodiment in FIG. 2*e*); this has two air outlets 6.31', of which one is arranged below the backing strip section 3.1 and one above. The two exiting flows of air S' are aligned at an angle to the direction of transport T and enable the guidance of a previously separated free end section of the backing strip section 3.1 into the opening, i.e. the inlet 6.42 of the parting unit 6.4, which here is designed in the shape of a funnel.

In addition in the example of embodiment in FIG. 2*e*) a sensor unit 6.5 with a sensor 6.51 is also provided, which can determine the position of the outer layer 3.12 of the backing strip roll 3.2.

FIG. 2*f*) shows yet another example of embodiment, which essentially corresponds with that shown in FIG. 2*e*), whereby however in the example of embodiment in FIG. 2*f*) the winding core 6.22, in particular its axis of rotation, lies in the same plane in which the backing strip section 3.1 is fed out of the labelling device 2. In this particular example this plane, in which the lower edge of the guidance element

6.11 also runs, runs horizontally. Here therefore the backing strip section 3.11 is fed onward by the guidance element 6.11 in precisely the horizontal direction to the winding core 6.22 at the moment when a new winding operation begins. In order to ensure the guidance of the end section 3.11 by the guidance element 6.11 to the winding core 6.22, two air outlets 6.31 are provided in this example of embodiment, of which one is arranged below the backing strip section 3.1 and one above. The airflows S exit in the same direction and at the same angle to the direction of transport T as the airflows S' of the air outlets 6.31'.

FIGS. 4*a*) and *b*) in each case show in perspective a winding core 6.22 in the state in which all pins 6.21 are projecting fully. Here FIG. 4*a*) shows an example of embodiment in which the pins 6.21 all project to the same extent, while FIG. 4*b*) shows an example of embodiment in which the pins in the fully extended position project to different extents. The pins 6.21 projecting the furthest in this position then serve to bear upon the end section of the backing strip section 3.1, whereby the pins projecting less far serve to fix the said end section for purposes of winding.

Finally in all examples of embodiment a winding device 6 and a control unit 6.6 are provided, which can execute one or a plurality of the following functions:

stopping or starting of the rotation of the winding core 6.22, stopping or starting of the parting unit 6.4, movement of one or a plurality of fixing means, or pins 6.21, into the extended position, or into the retracted position, switching on or off of one or a plurality of fan units.

The invention claimed is:

1. A labelling machine with a labelling device, which has a feeder unit for purposes of feeding a backing strip, which is provided with detachable labels, and a transfer unit for purposes of transferring the labels from the backing strip onto an object that is to be labelled, wherein the labelling machine furthermore has a winding device for purposes of winding on a section of the backing strip from which the labels have been detached, containing at least one guidance unit with a guidance element, along which the backing strip section can be guided in a direction of transport, and a winding unit, which is mounted downstream of the at least one guidance element, and comprises fixing means, on which a free end section of the backing strip section can be fixed, wherein the fixing means are arranged on a winding core that can rotate about an axis of rotation, and follow a rotational movement of the winding core, wherein the winding unit has as fixing means at least two pins extending parallel to the axis of rotation of the winding core and parallel to one another, and spaced apart from one another in a radial direction, wherein at least one of the pins can be moved independently from at least one other of the pins between an extended position and a retracted position, in which the pin in question protrudes less or not at all.

2. The labelling machine in accordance with claim 1, wherein the winding device further comprises a fan unit with at least one air outlet, which is aligned such that an airflow that exits from the latter deflects the backing strip section, after this has passed the guidance element, in a direction of the winding core.

3. The labelling machine in accordance with claim 1, wherein the winding device further comprises a parting unit with a parting element selected from the group consisting of a knife, a saw blade, one or a plurality of needles, a laser cutting head, and a rotatable parting disc, which can be moved into a position in which a severance of the backing strip section can take place.

4. The labelling machine in accordance with claim 1, wherein the winding device further comprises a sensor unit with at least one sensor for purposes of determining a position of an outer layer, and/or a diameter or radius or weight of a backing strip roll formed from a backing strip section wound on by means of the winding unit.

5. The labelling machine in accordance with claim 1, wherein the winding unit has as fixing means at least three pins extending parallel to the axis of rotation of the winding core and parallel to one another, and spaced apart from one another in the radial direction.

6. The labelling machine in accordance with claim 5, wherein all pins can be moved between an extended position and a retracted position, in which the fixing means in question protrudes less or not at all.

7. The labelling machine in accordance with claim 1, wherein a bearing element for being contacted by the end section is provided a surface of which lies on an imaginary straight line that runs through the axis of rotation of the winding core, and which lies tangentially on a surface of the guidance element, wherein a distance between the guidance element and the winding core is less than a distance between the guidance element and the bearing element.

8. The labelling machine in accordance with claim 7, wherein the at least one air outlet is designed such that an exiting airflow presses the backing strip section, after the latter has passed the guidance element, against the bearing element.

9. The labelling machine in accordance with claim 3, wherein the winding device further comprises a fan unit with at least one air outlet, which is aligned such that an airflow that exits from the latter deflects the backing strip section into an inlet of the parting unit.

10. The labelling machine in accordance with claim 3, wherein the parting element is mounted in a sprung manner.

11. The labelling machine in accordance with claim 1, wherein the winding device further comprises a control unit, which is configured such that, dependent on a signal generated by a sensor or dependent on a programmed or automatically measured value for the backing strip thickness:

it can slow down or stop a rotation of the winding core, and in particular can match it to the necessary speed of transport, and it can actuate a parting unit, and it can move the fixing means from the extended position into the retracted position, and it can switch on a fan unit.

12. The labelling machine in accordance with claim 1, wherein the winding device further comprises a control unit, which is configured such that dependent on throughput performance of the labelling machine it can move the fixing means from the retracted position into the extended position, and it can initiate or accelerate the rotation of the winding core, and it can switch off a fan unit.

13. A method for the labelling of objects with the use of a labelling machine in accordance with claim 1, in which the following steps are executed:

provision of at least one object that is to be labelled, feeding of a backing strip which is provided with detachable labels in a direction of transport to a transfer unit, transfer of labels detached from the backing strip in the transfer unit onto the at least one object that is to be labelled, as a result of which a backing strip section from which labels have been detached is obtained, feeding of a free end section of the backing strip section from which labels have been detached to a winding unit of a winding device, which is mounted downstream of the transfer unit, winding on of the backing strip section from which labels have been detached in the winding device, as a result of which a backing strip roll is obtained, severance of the backing strip section from which labels have been detached, as a result of which the backing strip roll is separated from the remaining backing strip section, and release of the separated backing strip roll from the winding unit, wherein the free end section is fixed to at least two pins, which serve as fixing means, wherein the pins are arranged on a winding core, which is rotatable around an axis of rotation, and follow a movement of rotation of the winding core, wherein the pins are spaced apart from one another in a radial direction and extend parallel to the axis of rotation of the winding core and parallel to one another, wherein at least one of the pins can be moved independently from another of the pins between an extended position and a retracted position, in which the pin in question protrudes less or not at all.

14. The method in accordance with claim 13, wherein the free end section of the backing strip section from which labels have been detached is automatically fixed in the winding device.

15. The method in accordance with claim 13, wherein a position of an outer layer and/or a diameter or radius or weight of the backing strip roll is determined during the winding operation and with an achievement of a prescribed reference value or range of reference values a signal is generated, whereupon, severance of the backing strip section from which labels have been detached is executed.

16. The method in accordance with claim 13, wherein in the step of releasing the separated backing strip roll from the winding unit the backing strip roll is automatically released from the winding unit and a subsequent winding operation is automatically started.

17. The method in accordance with claim 13, wherein dependent on a signal generated by a sensor or dependent on a programmed or automatically measured value for a backing strip thickness, a rotation of the winding core is slowed down, stopped, or matched to a necessary speed of transport the backing strip section is severed, the backing strip roll is released from the winding unit, or a fan unit blowing air onto the free end section of the backing strip section is switched on.

18. The method in accordance with claim 13, wherein dependent on throughput performance of the labelling machine, at the start of the winding operation the free end section of the backing strip section is fixed, the rotation of a winding core, which carries a later backing strip roll, is initiated or accelerated, or a fan unit blowing air onto the free end section of the backing strip section is switched off.

* * * * *